US012234710B2

(12) United States Patent
Hult et al.

(10) Patent No.: US 12,234,710 B2
(45) Date of Patent: Feb. 25, 2025

(54) DRIVE ASSEMBLY FOR A WELL SITE

(71) Applicant: EVOLUTION OIL TOOLS INC., Calgary (CA)

(72) Inventors: Vern Hult, Calgary (CA); Benjamin J Gagnon, Calgary (CA); Emery Stoesser, Calgary (CA); Bernard Lumori, Calgary (CA)

(73) Assignee: EVOLUTION OIL TOOLS INC., Calgary (CA)

( * ) Notice: Subject to any disclaimer, the term of this patent is extended or adjusted under 35 U.S.C. 154(b) by 0 days.

(21) Appl. No.: 18/067,976

(22) Filed: Dec. 19, 2022

(65) Prior Publication Data

US 2023/0193717 A1 Jun. 22, 2023

Related U.S. Application Data

(60) Provisional application No. 63/291,177, filed on Dec. 17, 2021.

(51) Int. Cl.
*E21B 43/12* (2006.01)
*E21B 33/04* (2006.01)

(52) U.S. Cl.
CPC ..... *E21B 43/126* (2013.01); *E21B 33/0415* (2013.01)

(58) Field of Classification Search
CPC ..... E21B 43/13; E21B 43/126; E21B 43/127
See application file for complete search history.

(56) References Cited

U.S. PATENT DOCUMENTS 546,626 A * 9/1895 Sheanfeld ..... E21B 43/126 74/109
1,623,696 A * 4/1927 Nugent ..... E21B 1/02 74/21
1,633,013 A * 6/1927 Gluyas ..... E21B 1/02 74/21
2,318,315 A * 5/1943 Johnston ..... E21B 43/127 74/21
2,444,842 A * 7/1948 McConahey ..... E21B 43/127 24/122.3
2,595,434 A * 5/1952 Williams ..... E21B 43/127 192/33 R
4,844,171 A * 7/1989 Russell, Jr. ..... E21B 19/167 166/380

(Continued)

FOREIGN PATENT DOCUMENTS

CN 2086791 U 10/1991
CN 2426524 Y 4/2001

(Continued)

OTHER PUBLICATIONS

"Materials for Tulsa Oil Tool Driver", Tulsa Oil Tools, Columbia, South America, document available prior to Dec. 2021.

*Primary Examiner* — David Carroll
(74) *Attorney, Agent, or Firm* — Bennett Jones LLP

(57) ABSTRACT

A drive assembly for a tubing rotator comprising: a linear force to motive force convertor including an input for receiving a linear motion drive force and an output for outputting a rotary motion drive force, an arm for receiving a linear drive force and inputting it to the linear force to motive force convertor and an actuator couplable to a polish rod and configured for transmitting a linear drive from the polish rod to the arm.

17 Claims, 5 Drawing Sheets

(56) References Cited

U.S. PATENT DOCUMENTS

| | | | | |
|---|---|---|---|---|
| 9,541,073 | B2 * | 1/2017 | Rappenecker | F04B 9/045 |
| 10,125,582 | B1 * | 11/2018 | Johnson | E21B 17/04 |
| 2013/0302183 | A1 * | 11/2013 | Gregory | F04B 17/006 417/53 |
| 2022/0412339 | A1 | 12/2022 | Gayubas et al. | |

FOREIGN PATENT DOCUMENTS

| | | | |
|---|---|---|---|
| CN | 2605380 | Y | 3/2004 |
| CN | 201874508 | U | 6/2011 |
| CN | 203729907 | U | 7/2014 |
| RU | 2155859 | C2 | 9/2000 |
| RU | 2160817 | C2 | 12/2000 |

* cited by examiner

DRIVE ASSEMBLY FOR A WELL SITE

FIELD OF THE INVENTION

This invention relates to an apparatus for driving devices at a well site. In particular, the drive apparatus employs the drive motion of a polish rod to drive other devices at a well site.

BACKGROUND OF THE INVENTION

At a wellsite, the production tubing string serves to support the rod pump and polish rod and provides a means to extract oil. During production on a rod pump system, the polish rod moves up and down with the stroke of a pump jack. In particular, the polish rod is driven up and down along its long axis to drive the pumping action of the rod pump. The polish rod extends up through the inner diameter of the production tubing string.

Many well sites have no source of grid power. However, they do have devices such as tubing rotators or chemical pumps that must be driven to operate.

As an example, the production tubing string is often rotated in order to more evenly distribute wear on its inside surface due to contact with the polish rod. Rotation may be via a tubing rotator. When a tubing rotator is used, it has a hanger body coupled to and supporting the tubing string. Rotation of the hanger body rotates the tubing string. The tubing rotator hanger body is driven to rotate within a housing of the tubing rotator by a gear assembly. If there is no grid power supply, power is provided by a generator but this requires refueling and considerable maintenance.

SUMMARY OF THE INVENTION

The invention provides a drive for a wellsite device.

In accordance with one broad aspect of the invention, there is provided a drive assembly for a wellsite device comprising: a linear to motive force convertor including an input for receiving a linear motion drive force and an output for outputting a motive drive force, an arm for receiving a linear drive force and inputting it to the linear to motive force convertor and an actuator couplable to a polish rod and configured for transmitting a linear drive from the polish rod to the arm.

In accordance with another broad aspect, there is provided a wellhead installation comprising: a polish rod drive, including a polish rod, for a downhole rod pump; a wellsite device; an actuator couplable to a polish rod and configured to move linearly with the polish rod; an arm free of connection to the polish rod and positioned adjacent to the polish rod for receiving a linear drive force by abutment with the actuator and a linear force to motive force convertor including an input, coupled to the arm and configured for receiving a linear motion drive force from the arm, and an output for outputting a motive drive force to the wellsite device.

In accordance with a further broad aspect, there is provided a method for driving a wellsite device at a wellsite, the method comprising: connecting an actuator to a polish rod such that the actuator moves up and down with the polish rod as it strokes; positioning an arm adjacent to but free of connection to the polish rod to be acted upon by the actuator, thereby to transfer an input of linear motion from the polish rod to the arm; connecting the arm to a convertor to convert the input of linear motion to a motive drive force and inputting the motive drive force to the wellsite device.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF VARIOUS EMBODIMENTS

Figure 1:
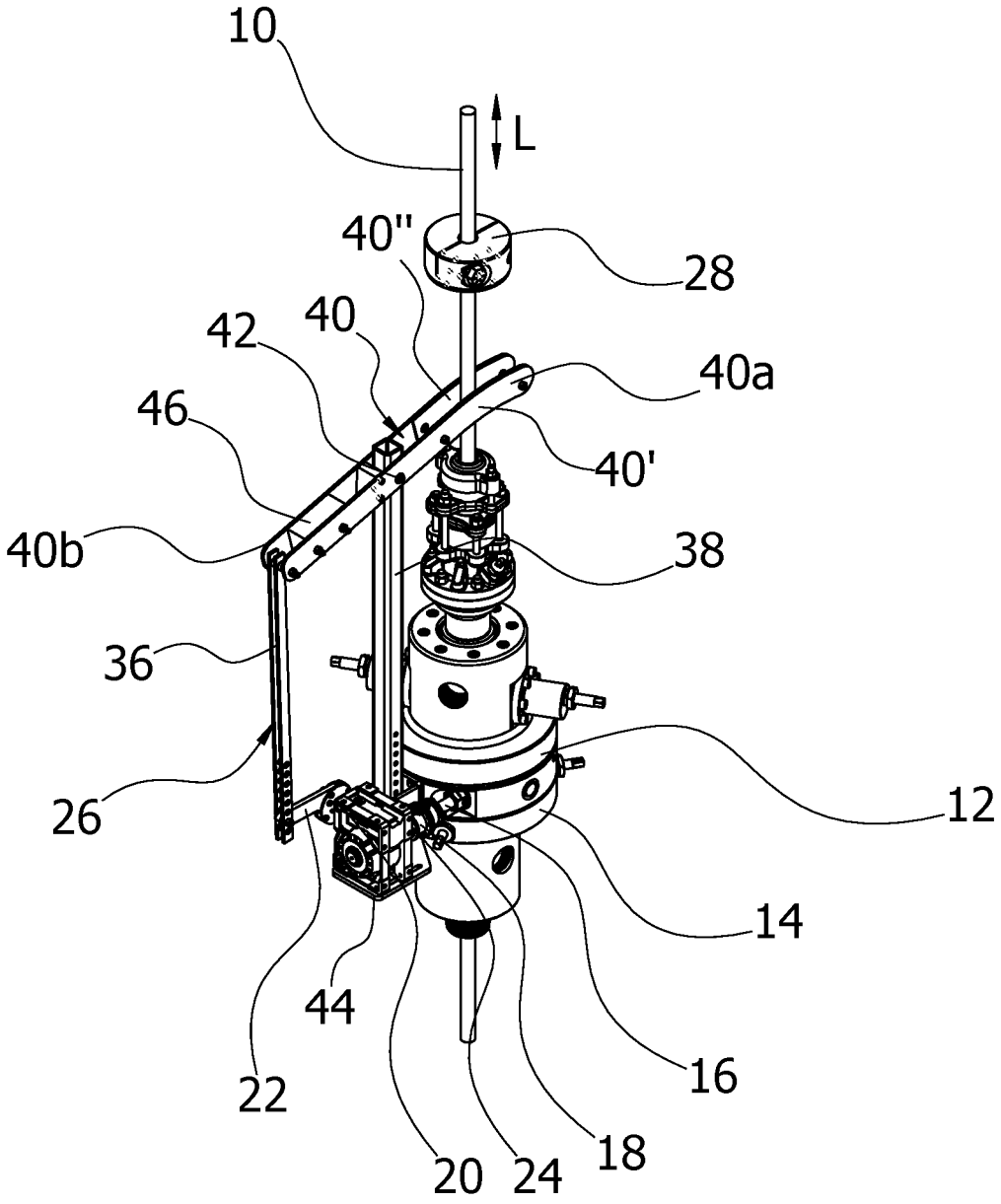
FIG. 1 is a perspective view of a wellhead installation including a wellsite device and a drive assembly for a wellsite device.

This invention is directed to a drive system for a wellsite device. The drive system is mechanical, not reliant on an input of electrical power or hydraulics. The drive system uses the linear drive of the polish rod and converts that linear drive to a drive for the wellsite device. In one embodiment, the drive system uses the downward linear motion of the polish rod to engage mechanisms that drive the wellsite device. It is useful to employ the downward motion, rather than the upstroke, because the downward movement of the polish rod, as driven by the horsehead of the pump jack, is known and limited to avoid mechanical contact between the pump components on the pump downhole. Since the polish rod and devices are important and expensive structures on the well, the drive system can be configured with mechanisms to prevent damage to the polish rod and to the device during use.

With reference to the Figures, the drive system is useful on a wellhead installation including: a polish rod 10 and a wellsite device, such as a tubing rotator 12, that needs to be driven to operate. While the following focuses on a tubing rotator as the wellsite device, the technology can be applied to other devices, such as a chemical pump, that need to be driven to operate.

The polish rod 10 is linearly driven up and down (arrow L) such as by a pump jack, not shown. The linear drive of the polish rod drives a rod pump in a production tubing downhole.

The tubing rotator 12 is supported on the wellhead 14 and supports the production tubing that extends down into the well below the wellhead. The tubing rotator includes a hanger body (not shown) driven via a gear assembly 16. Gear assembly 16 rotates the hanger body by receiving an input of motive force, in this embodiment, rotary motion. In this embodiment a shear coupling 18 is positioned at an input end of the gear assembly 16 to prevent overloading of the driven load.

The drive system includes a linear force to motive force convertor 20 including an input 22 for receiving a linear motion drive force indirectly from the polish rod 10 and an output 24 for outputting a motive drive force, such as a rotary drive force, directly or indirectly to the tubing rotator. The drive system also includes an arm 26 for receiving a linear drive force from the polish rod and inputting it to the linear force to motive force convertor 20 and an actuator 28 couplable to the polish rod and configured for transmitting the linear drive from the polish rod 10 to the arm 26.

Actuator 28 is a structure that is couplable to the polish rod 10 and configured to communicate the linear movement of the polish rod to impart linear movement to the arm 26. In one embodiment, the actuator is configured to only communicate linear downward movement of the polish rod to the arm. While the actuator could include a physical coupling between the arm and the actuator, in one embodiment, the actuator is free of any physical coupling to the arm. In such an embodiment, the actuator is separate from the arm and not directly connected via any connection (no hinge, link, cable, etc.) to the arm.

In one embodiment, actuator 28 is a clamp that clamps onto the polish rod 10 and creates an enlargement on the polish rod that can butt against a portion of the arm on the down stroke of the polish rod. In one embodiment, the actuator is a disk-shaped clamp, such as including clamp parts 30*a*, 30*b*. When clamped together the parts 30*a*, 30*b* define a ring shaped disk with a central opening 31 between them sized to accommodate the polish rod therein. The disk shaped body has a diameter larger than the polish rod diameter.

As noted, the polish rod is an expensive component of the well. Therefore, it is desirable that the actuator be couplable to the polish rod but not damage or score it. In one embodiment, the central opening 31 has a liner 31*a* constructed of a material such as plastic that is softer than the polish rod steel and, therefore, not capable of damaging the polish rod.

The actuator 28 is connected to the polish rod 10 to move with it and apply a force to the arm 26 when the actuator butts against the arm. The connecting force of the actuator to the polish rod may be selected to ensure that if excessive forces are encountered as the actuator bears against the arm, the actuator can release from its actuating position, such as slip along the polish rod or break off the polish rod. For example, the clamping force of the actuator on the polish rod can be selected to allow for normal operation to occur, but can be overcome to allow the actuator to slip up the polish rod if an excess amount of force is applied to the arm. The actuator, for example, can include an internal spring mechanism 32 through which the clamping force can be set to be capable of being overcome.

The arm 26 may also include a shear mechanism to ensure that it can be released if something in the drive assembly ceases. This shear mechanism takes the arm off line, for example disconnects the arm from its position adjacent the polish rod, disconnects the arm from its drive connection to the convertor or otherwise allows the arm to move freely, so that the polish rod can continue to function without the actuator being hindered by the arm.

To reduce shocks and reduce wear between the actuator and the arm, the actuator at least on its surface that contacts arm 26 may be plastic or elastomeric. In one embodiment, a lower pad 33 of plastic is connected on the lower end of the actuator.

Actuator 28 engages an upper portion of the arm 26 on each downward stroke of the polish rod. The arm can be positioned adjacent to the polish rod, and within the path of the actuator as it is moved by the polish rod. The arm generally is not coupled to or in contact with the polish rod to mitigate damage to the polish rod. The upper end of the arm in it highest position, also called it neutral position, is just below the actuator at the upper limit of its stroke length. The actuator, as it is stroked down, then, butts and pushes against the arm. Actuator 28 can be clamped onto the polish rod near the bottom of the polish rod stroke to be close to the tubing rotator. By placing the actuator 28 near the bottom of the polish rod stroke, the arm height can be minimized.

The arm 26 transfers the linear, for example downward linear, motion of the polish rod to the convertor 20. In one embodiment, the arm 26 includes a main arm structure 36 that is rigid and elongate and is the main structure through which the linear motion is transmitted. Therefore, main arm structure 36 acts as a linear force transmission shaft. In another embodiment, the arm 26 includes the main arm structure 36 as a part of an arm assembly including a linkage and lever. In one embodiment, for example, arm 26 is configured as an assembly including a support post 38 and a lever 40 connected at its fulcrum 42 onto the post. A first, effort end 40*a* of the lever is acted upon by the actuator 28 and the opposite, load end 40*b* of the lever, on the other side of the fulcrum from the first end, is pivotally coupled to the main arm structure 36. Thus, movement of the actuator down against the first end 40*a* of the lever causes the main arm structure to be pulled up. The use of a lever and linkage to the main arm provides facilitates receiving and transmitted the linear force. The arm assembly with lever and linkage to the linear transmission arm 36 minimizes shocks and damage to the polish rod.

The arm 26 can further include a base 44 where post is mounted. Base 44 can be configured for securing to the ground or to a wellhead structure, such as to the wellhead or the tubing rotator. In the illustrated embodiment, the base includes receptacle that connects onto mounting bolt.

Support post 38 is height adjustable, for example, as by use of a telescoping and pinned adjustment. The main arm 36 is also length, and thereby stroke length, adjustable. Main arm 36 may for example, include a telescoping and pinned structure for length adjustment. The adjustments allow for different wellhead configurations and selection of stroke length.

The shear mechanism for arm 29 may be incorporated into various parts on arm 36 or connections between arm 36 and lever 40. In one embodiment, the shear mechanism may be incorporated into the telescoping and pinned connection on arm 36.

Lever 40 is positioned to be acted upon by the actuator, as the actuator is moved by the polish rod. In one embodiment, the lever is a dual arm structure with two parallel arms 40', 40". As such, the two arms can be positioned on either side of the polish rod, so that the lever stays in a position to be acted upon by the actuator. The space between the arms 40', 40" is smaller than the diameter across the actuator. While a connector could be employed between arms 40', 40" at end 40*a*, the connector may be omitted for various reasons but for example, to avoid the arm 26 contacting the polish rod and to facilitate installation of the lever 40 onto a well.

As noted, lever 40 is acted upon by the actuator 28 on the down stroke of the polish rod. Lever 40 is moved from a high position to a lower position by this action. Lever 40 is biased to return to the high position after each downward stroke. In one embodiment, the lever has a weight 46 on its load end 40*b* that biases the lever back into the high position. Biasing could alternatively be achieved by use of torsion, tension or compression springs, or gas shocks, for example.

Arm 26 may include a stop 47 to control the maximum upward movement, such as a stop near fulcrum 46 to limit the upward rotation of the lever. The stop may be adjustable to allow for different wellhead configurations.

Arm 26 transmits the linear drive force from the polish rod to the linear force to motive force convertor 20. In one embodiment, arm 26, for example, main arm 36, is connected to convertor 20 at input 22 by a pivoting connection 46.

The convertor may be any mechanism that converts a linear force input to a motive force suitable for the device to be driven. In one embodiment, such as for a tubing rotator, the linear force input is converted to a rotary force output. The convertor may include a gear rate adjuster, such as a reducer. This is useful where the frequency of the polish rod actuation is too rapid/great or too slow/small for the device. For example, in a tubing rotator embodiment, a gear reducer may be of interest to ensure the tubing rotator is turned slowly. The converter may also have an output directional change, such as a right hand or left hand gear mechanism.

In some embodiments, the device only requires a one way motive force. As such a clutch or ratchet may be required to transmit only a one way motive force to operate the device. The device may have the one way mechanism. If not or as a failsafe, the convertor may be configured to output only a one way motive force. For example, the convertor may have a mechanism to output rotary drive only in one direction. For example, there may be a release, ratchet, backspin preventor or other means to prevent reverse rotation from being output from the convertor. Therefore, convertor 20 can accommodate the reverse movement of arm 26 as it returns to a start, neutral position without any reverse rotational drive being output into the device. Converter 20 may, for example, operate using a clutch with backspin preventer 20*a* (FIG. 3) or a ratcheting wrench mechanism 20*b*.

Figure 3:
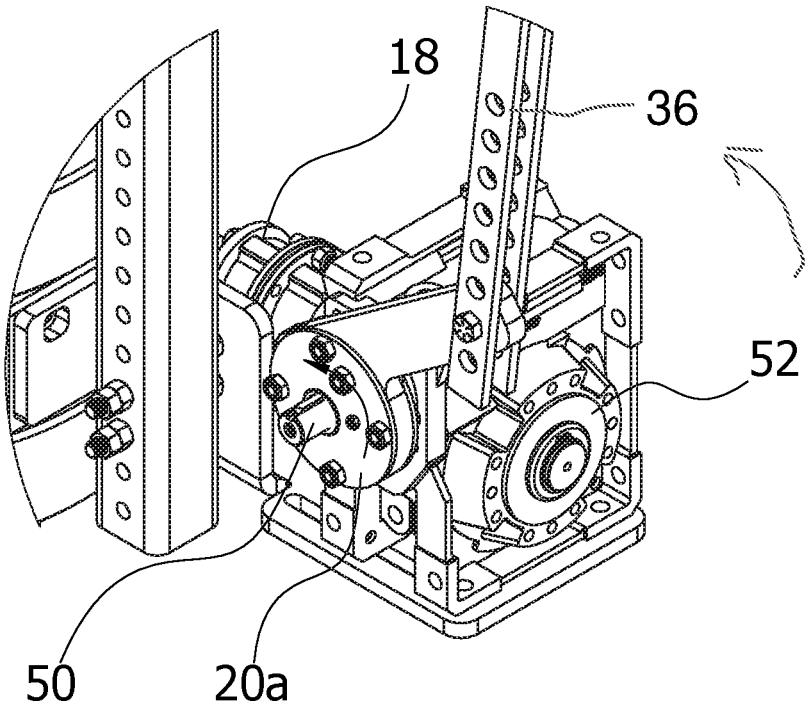
FIG. 3 is an enlarged, perspective view of a drive convertor.
Figure 4A:
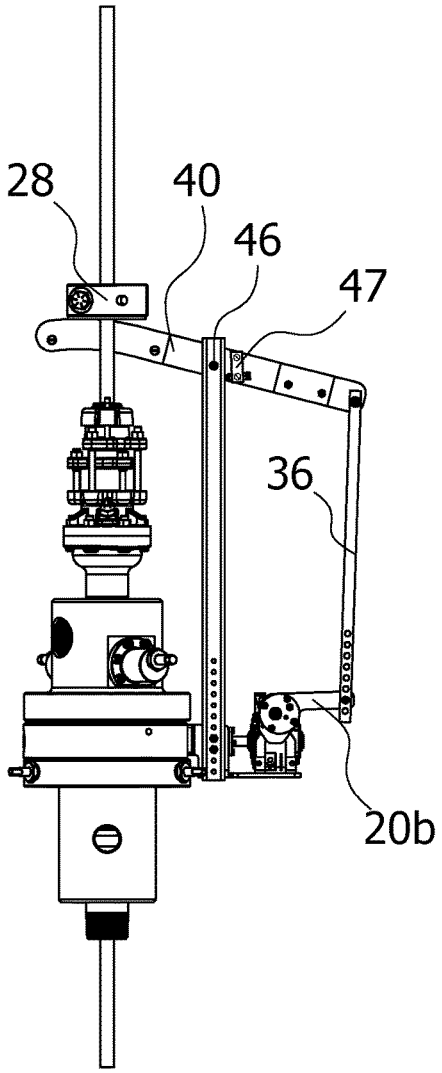
FIG. 4A is a side elevation of another wellhead installation.
Figure 4B:
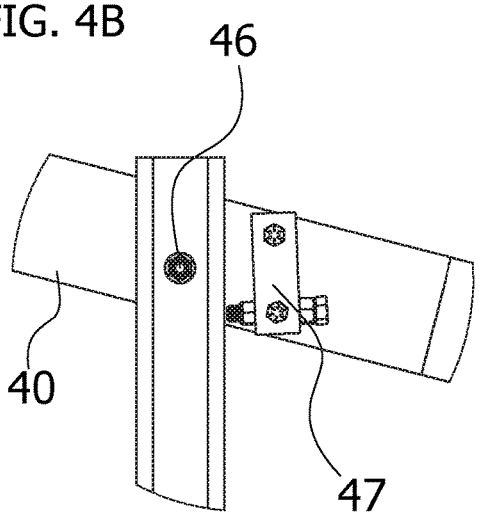
FIG. 4B an enlarged view of the fulcrum area between the lever and the post from FIG. 4A.
Figure 5:
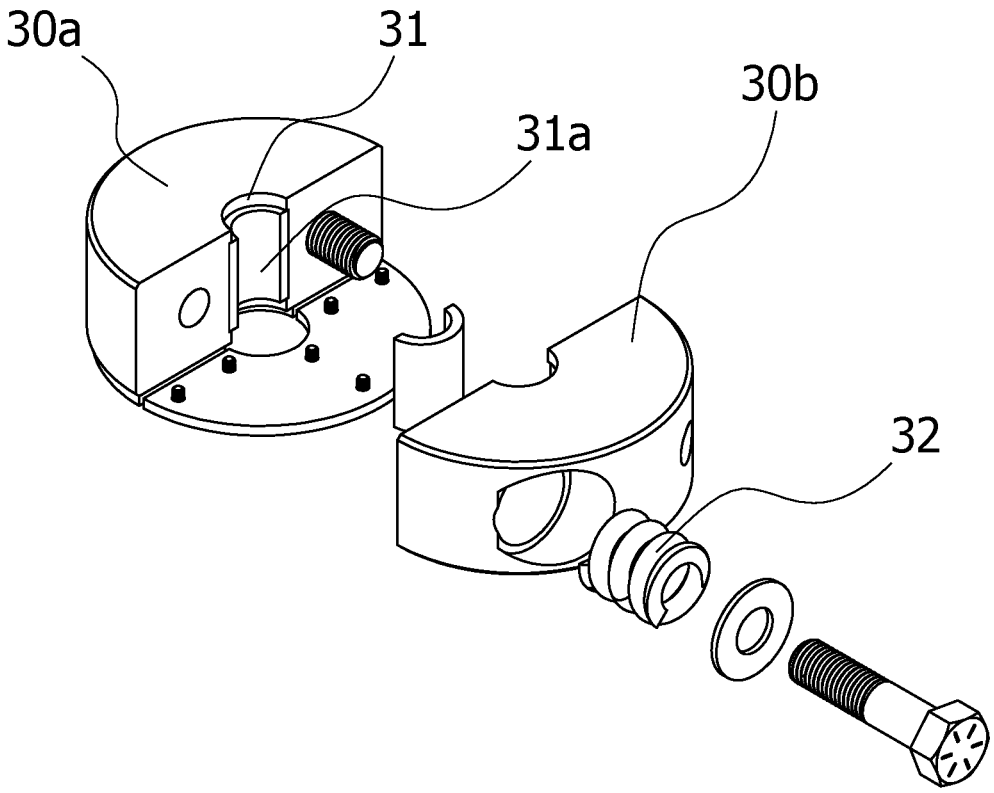
FIG. 5 is an enlarged view of an actuator for installing on a polish rod.

In one embodiment, for example as shown in FIG. 3, the convertor includes a clutch with a backspin preventer 20*b*. Arm 36 is connected by a pivoting connection to input linear motion to the converter and the linear motion is received by a main shaft 50 and clutch. The backspin preventor ensures that the convertor only outputs rotary motion in one direction (see the arrow), when arm 36 is pulled up by the lever. When the arm moves back down, that reverse movement is not transmitted through to coupling 18 and the gear of the tubing rotator. The clutch and preventer may be roller style mechanisms. This convertor also includes a right hand, reducing gear box 52.

In another embodiment, the linear force to motive force convertor employs a ratcheting mechanism 20*b*. For example, the adjustable connecting arm 36 is pivotally connected to and turns an attached ratcheting wrench by approximately 90 degrees with each downward stroke. The ratcheting wrench transfers that motion through a right-angle gearbox reducer through to the shear coupling, and thus through to the tubing rotator 12, thereby turning the production tubing. When arm 36 returns to the upper position, the ratcheting mechanism allows the wrench to reverse back without imparting reverse drive to the output of the convertor.

The total allowable swing of the wrench may be adjusted with a bolt-type stop 47 attached to the lever which limits the motion of the lever around its fulcrum 46 and acts as a positive stop against the central support post.

The drive actuates the rotator during the downward stroke rather than the upstroke. This is useful since the downward extent of the horsehead is limited to avoid mechanical contact between the plunger and the pump downhole.

Figure 2A:
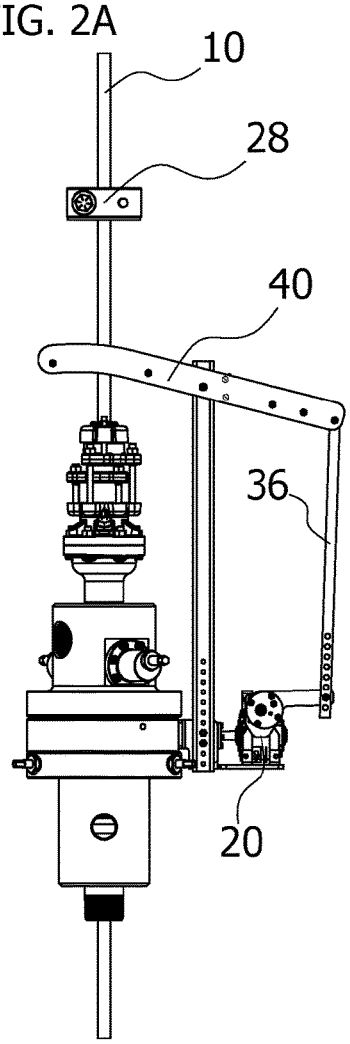
FIGS. 2A to 2C are a sequence of side elevations of the wellhead installation of FIG. 1. The sequence shows various positions of the drive assembly for driving the wellsite device.
Figure 2B:
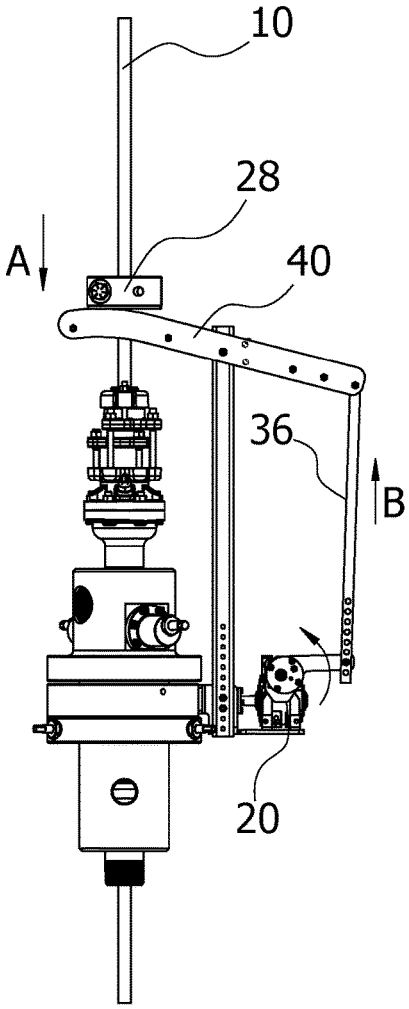
Figure 2C:
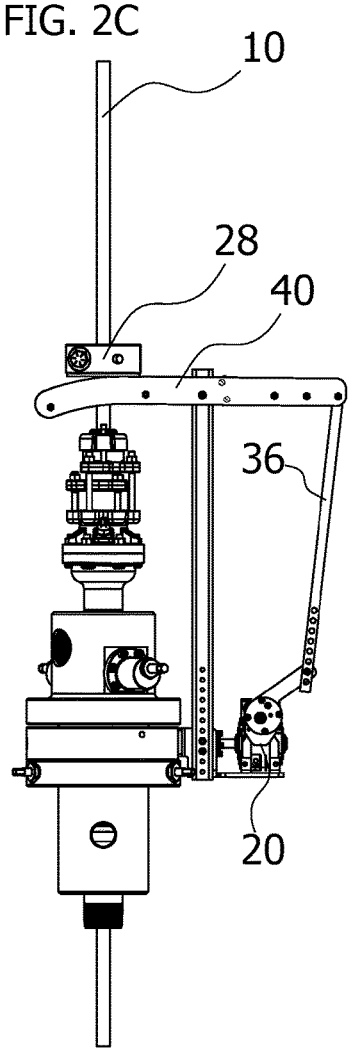

FIGS. 2A, 2B and 2C show the functioning of the drive assembly. Overall, the operation includes connecting actuator 28 to a polish rod 10 such that the actuator moves up and down with the polish rod as it strokes. Then, arm 26 is positioned adjacent to but free of connection to the polish rod. In this position, the arm is in the path to be acted upon by the actuator, thereby to receive an input of linear motion from the polish rod through interaction with the actuator. The arm is then connected to a convertor to input the linear motion to the convertor. The convertor converts the input of linear motion to a motive drive force. The motive drive force is input from the convertor to the wellsite device.

FIG. 2A shows lever 40 and arm 36 in a neutral position, where the effect end of lever 40 is in a high position awaiting actuator 28 to be moved down with the polish rod, wherein actuator 28 makes contact with the lever and linearly moves arm 36.

FIG. 2B shows the contact position, where actuator 28 is driven to make contact with the lever 40. At this point, polish rod 10 and actuator 28 are moving down. Contact between actuator 28 and lever drives the effort end 40*a* of the lever down (arrow A). This downward force moves arm 36 linearly up (arrow B). This upward movement is communicated to convertor 20 and the upward pull causes convertor 20 to generate a rotational force (arrow R).

FIG. 2C shows the full down position of the drive assembly. In this position, actuator 28 is at its lowest position, timed to the pump jack and polish rod 10 lowest positions. Lever 40 effort end 40*a* is fully pushed down and arm 36 has reached the peak of its linear pull force on convertor 20.

After FIG. 2C, the polish rod 10 and actuator 28 are stroked back up. Lever 40 is also biased to return to the neutral, highest position (FIG. 2A). This movement moves arm 36 back to its neutral, position. This upward movement does not rotationally reverse the convertor 20. Instead, the convertor permits this reverse movement via a ratchet, slip or backspin preventor.

It is to be understood that what has been described are preferred embodiments of the invention and that it may be possible to make variations to these embodiments while staying within the broad scope of the invention. Some of these variations have been discussed while others will be readily apparent to those skilled in the art.

We claim:

1. A drive assembly for a tubing rotator or a chemical pump, the drive assembly comprising: a linear force to motive force convertor including an input structure for receiving a linear motion drive force and an output structure for outputting a motive drive force, an arm for receiving a linear drive force and inputting it to the linear force to motive force convertor and an actuator couplable to a polish rod and configured for transmitting linear movement of the polish rod to the arm, wherein the arm includes a lever connected for operation around a fulcrum and a linear force transmission shaft pivotally connected between the lever and the linear force to motive force convertor, wherein an end of the lever is positioned to be acted upon by the actuator and the shaft is connected on a load end of the lever and further comprising a biasing member to bias the load end of the lever into a lower position and wherein the linear force to motive force convertor outputs the motive drive force when the linear force transmission shaft is pushed down by the lever and the lever is biased by the biasing member to return to an uppermost position.

2. The drive assembly of claim 1 wherein the motive force is a rotary force.

3. The drive assembly of claim 1, wherein the biasing member is a weight, a spring or a shock.

4. The drive assembly of claim 1, further comprising a stop to limit rotation of the lever around the fulcrum.

5. The drive assembly of claim 1 wherein the actuator includes a release mechanism to allow the actuator to slide along the polish rod when excessive force is applied to the actuator.

6. A wellhead installation comprising: a polish rod drive, including a polish rod, for a downhole rod pump; a wellsite device selected from a tubing rotator or a chemical pump; an actuator couplable to a polish rod and configured to move linearly with the polish rod; an arm free of connection to the polish rod and positioned adjacent to the polish rod for receiving a linear drive force by abutment with the actuator; and a linear force to motive force convertor including an input structure, coupled to the arm and configured for receiving a linear motion drive force from the arm, and an output structure for outputting a motive drive force to the wellsite device, wherein the arm includes a lever connected for operation around a fulcrum and a linear force transmission shaft pivotally connected between the lever and the linear force to motive force convertor, wherein an end of the lever is positioned to be acted upon by the actuator and the shaft is connected on a load end of the lever and further comprising a biasing member to bias the load end of the lever into a lower position and wherein the linear force to motive force convertor outputs the motive drive force when the linear force transmission shaft is pushed down by the lever and the lever is biased by the biasing member to return to an uppermost position.

7. The wellhead installation of claim 6 wherein the wellsite device is a tubing rotator and the linear force to motive force convertor outputs a rotary motive force.

8. The wellhead installation of claim 6, wherein the biasing member is selected from a weight, a spring or a shock.

9. The wellhead installation of claim 6, further comprising a stop to limit rotation of the lever around the fulcrum.

10. The wellhead installation of claim 6 wherein the actuator includes a release mechanism to allow the actuator to slide along the polish rod when excessive force is applied to the actuator.

11. A method for driving a tubing rotator or a chemical pump at a wellsite, the method comprising: connecting an actuator to a polish rod such that the actuator moves up and down with the polish rod as the polish rod strokes; positioning an arm adjacent to but free of connection to the polish rod to be acted upon by the actuator on a downstroke of the polish rod, impacting the arm with the actuator during the downstroke of the polish rod thereby to transfer an input of linear motion from the polish rod to the arm on the downstroke of the polish rod; connecting the arm to a linear force to motive force convertor to convert the input of linear motion to a motive drive force; inputting the motive drive force to the tubing rotator or the chemical pump; and after impacting, biasing the arm such that the arm returns to a position ready for a next impact by the actuator.

12. A wellhead installation comprising: a polish rod drive, including a polish rod, for a downhole rod pump; a wellsite device selected from a tubing rotator or a chemical pump; an actuator couplable to a polish rod and configured to move linearly with the polish rod; an arm free of connection to the polish rod and positioned adjacent to the polish rod for receiving a linear drive force by abutment with the actuator; and a linear force to motive force convertor including an input structure, coupled to the arm and configured for receiving a linear motion drive force from the arm, and an output structure for outputting a motive drive force to the wellsite device, wherein the actuator includes a release mechanism to allow the actuator to slide along the polish rod when excessive force is applied to the actuator.

13. The wellhead installation of claim 12 wherein the release mechanism is a clamp.

14. The wellhead installation of claim 13 wherein the actuator includes an internal spring mechanism through which the clamping force of the clamp can be set to be capable of being overcome.

15. A drive assembly for a tubing rotator or a chemical pump, the drive assembly comprising: a linear force to motive force convertor including an input structure for receiving a linear motion drive force and an output structure for outputting a motive drive force, an arm for receiving a linear drive force and inputting it to the linear force to motive force convertor and an actuator couplable to a polish rod and configured for transmitting linear movement of the polish rod to the arm, wherein the actuator includes a release mechanism to allow the actuator to slide along the polish rod when excessive force is applied to the actuator.

16. The drive assembly of claim 15 wherein the release mechanism is a clamp.

17. The drive assembly of claim 16 wherein the actuator includes an internal spring mechanism through which the clamping force of the clamp can be set to be capable of being overcome.

* * * * *